US006775960B2

(12) United States Patent
Hansen

(10) Patent No.: US 6,775,960 B2
(45) Date of Patent: Aug. 17, 2004

(54) SEPARATION OF JOINED SHEETS

(75) Inventor: Erik J. Hansen, Horsens (DK)

(73) Assignee: Schur Packaging Systems A/S, Horsens (DK)

( * ) Notice: Subject to any disclaimer, the term of this patent is extended or adjusted under 35 U.S.C. 154(b) by 0 days.

(21) Appl. No.: 10/102,011

(22) Filed: Mar. 21, 2002

(65) Prior Publication Data

US 2002/0166307 A1 Nov. 14, 2002

(30) Foreign Application Priority Data

Mar. 23, 2001 (DK) ..... PA 2001 00481

(51) Int. Cl.[7] ..... B65B 43/00
(52) U.S. Cl. ..... 53/492; 53/381.1
(58) Field of Search ..... 53/492, 381.1, 53/381.5, 381.6, 386.1

(56) References Cited

U.S. PATENT DOCUMENTS

| | | | | | |
|---|---|---|---|---|---|
| 2,461,573 | A | | 2/1949 | Schweizer | |
| 3,381,447 | A | * | 5/1968 | Ash et al. | 53/381.6 |
| 3,711,083 | A | | 1/1973 | Cantrell, Sr. | |
| 3,755,049 | A | * | 8/1973 | Leloux | 53/386.1 |
| 3,785,410 | A | * | 1/1974 | Carter | 53/386.1 |
| 4,262,471 | A | * | 4/1981 | Russell | 53/381.6 |
| 4,271,656 | A | * | 6/1981 | Russell | 53/381.6 |
| 5,082,256 | A | | 1/1992 | Bryson | |
| 5,474,414 | A | * | 12/1995 | Tovini et al. | 53/381.6 |
| 5,823,320 | A | | 10/1998 | Seidel et al. | |

FOREIGN PATENT DOCUMENTS

| | | | | |
|---|---|---|---|---|
| DE | 4435294 A1 | * | 6/1995 | B65B/43/30 |
| GB | 308294 | | 8/1929 | |
| GB | 1519282 | | 7/1978 | |
| JP | 11301620 A | * | 11/1999 | B65B/43/30 |
| NL | 8800240 | | 9/1989 | |
| WO | WO 87/07881 | | 12/1987 | |

* cited by examiner

*Primary Examiner*—Stephen F. Gerrity
(74) *Attorney, Agent, or Firm*—Nixon Peabody LLP; David S. Safran

(57) ABSTRACT

The present invention concerns a device, an arrangement and a method for opening or separating two closely joined sheets of flexible material, e.g. sheet pieces and folded pieces of film or paper, by applying vacuum on the opposite outer sides of these joined sheets. Typically, the case is opening different packing wrappers or large bags or envelopes, which are to be opened for receiving inserts, e.g. diverse advertisement prints, and which are to be handled with great reliability and rather large capacity, e.g. 5,000 to 25,000 pcs. per hour.

10 Claims, 2 Drawing Sheets

SEPARATION OF JOINED SHEETS

The present invention concerns a device, an arrangement and a method for opening or separating two closely joined sheets of flexible material, e.g. sheets or folded pieces of film or paper, by applying vacuum on opposite external sides of these joined layers. The device includes at least one pail of mutually opposite leaves that are pivotably connected along an edge at a lower part of the leaves, and where at least one leaf is provided with an bend at a centre area, the bend directing an upper part of the leaf outward and away from the opposite leaf so that at least one of the upper leaf parts is oriented away from the opposite upper leaf part the leaves each being provided with an aperture adapted as connection for a vacuum source.

Typically, we are speaking of opening different packing wrappers or large bass or envelopes to be opened for receiving inserts, e.g. sundry advertisement prints, and which are to be handled with great safety and rather large capacity, e.g. 5000 to 25,000 pieces per hour.

It is wellknown to open flat wrapper items by means of suction cups which are sucked fast on opposite sides and then moved from each other, but since it is nearly always very difficult to pull two closely joined sheets from each other, this method has not appeared to be sufficiently sure for reliable operation with high capacity.

By the present invention, the joined sheets are guided into a wedge space with folding walls which in the folded state squeezes an intermediate area of the sleets between perforated, local wail parts for applying subpressure from outside, the perforations being connected with grooves extending in the outward direction at the inner sides of the walls, i.e. outward towards the external opening of the said wedge space, as at least one of these inner wall sides outside the said local wall parts continues in an outward bending course towards the outer opening for forming an outer wedge space in the folded state of the walls.

The invention is peculiar in that the connection to the vacuum source is arranged via an opening at a position below the bend, and that this opening is connected with one or more grooves extending in the surface of the side walls from the position under the bend, past the bend and to a position on the upper, outward bending leaf part.

Furthermore, the invention concerns an arrangement including a number of devices according to the invention and peculiar in that the devices are radially mounted in star configuration on a rotary wheel, so that the opening of each device faces away from the centre of revolution of the wheel.

Finally, the invention concerns a method being peculiar in that

- the joined sheets are inserted between two leaves, of which one leaf is partly bent outwards and away from the opposite leaf;
- the leaves are moved towards each other by turning about a common connection axis,
- vacuum is established through a number of perforations provided in the leaf surfaces and facing the joined sheets, whereby the outer layers of the sheets is sucked onto each leaf surface;
- the suction against the leaf surfaces propagates successively up along the sheets; and
- the two leaves are tilted away from each other with the sheets sucked upon each their leaf.

Quite a few tests with 'opening flaps' have been unsuccessful, but with the above, rather simple measures a surprisingly efficient and reliable function of the devices has been noted, also by high capacity and at least in the case of handling items which are not completely airtight. The items are opened by a successive mutual "peeling off", which appears to be considerably more reliable that attempts on a plane parallel pulling. The effect may somehow be difficult to explain, but it has been demonstrated that it is attainable.

It is to be mentioned that the invention provides for a further and attractive application, namely opening not only double sheets but also folded multilayer products joined at the back, such as newspapers. It is common practice that diverse inserts, e.g. in the form of regional or special supplements, are to be laid into folded newspapers delivered from a rotary press, and that it is prior art to perform a required opening of the folded newspapers by means diverse mechanical gripping and opening means. These, however, are to operate so quickly that operational problems may arise, and the present invention is interesting as a possible alternative or supplement to this technique.

The invention may particularly be considered when it is provided that the mentioned opening by vacuum occurs close to the side edge of the folded item which is constituted by the back edge of the unfolded item as the transfer of the opening action to the other sheets in the item then will occur immediately through the item back edge. If at one side edge of the folded item there is formed a reliable initial opening of the item at first, it may, if needed, be secured with other means that his opening propagates rapidly along the rest of the folded item.

In connection with the present invention "upper" and "lower" are not to be understood as concerning vertical orientation, but are only indicating an orientation farther from or closer to the pivotable connection between the walls.

The invention is explained more closely with reference to the drawing in the following in which.

Figure 1:
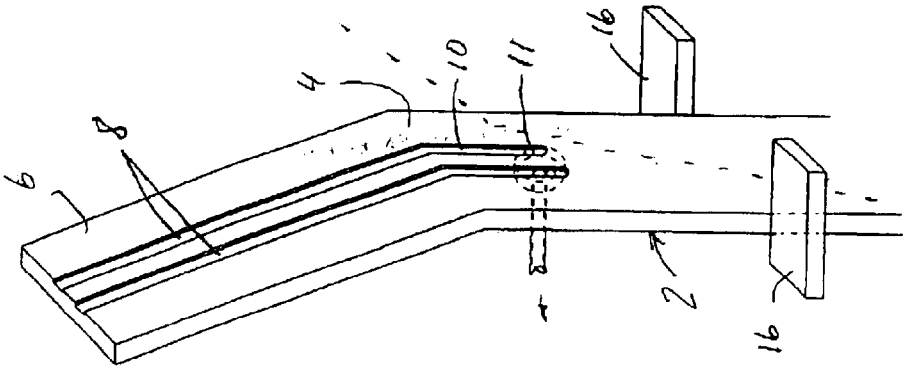
FIG. 1 is a perspective view of a device according to the invention.

As shown and outlined in FIG. 1. a device according to the invention consists of a pair of oppositely disposed plates 2 which at a lower end part 3 (FIGS. 5–7) are tiltably interconnected, and which in an intermediate area are provided with a bend 4 away from each other for forming upper, mutually angled plate parts 6, i.e. one part is bent away from the opposite part of the upper plate parts.

In these upper plate parts 6 there are formed a pair of longitudinal grooves 8 that continues downward from the bends 4 to respective lower areas 10, in which the lower ends of the grooves 8 are connected with real ward extending hole communications to respective suction heads 12 that are communicating with a vacuum source via suction hoses 14.

Figure 7:
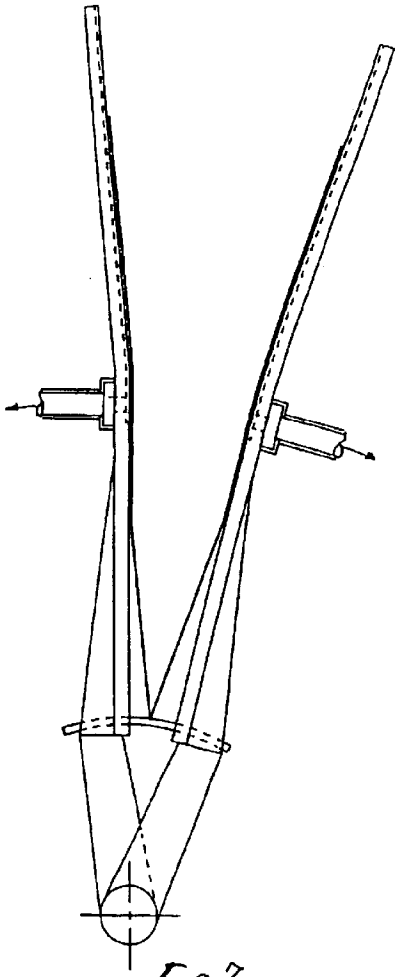
FIGS. 5–7 are side views of the device in different operational stages.

Laterally off and outside the lower plates 2 there are disposed support pieces 16 for carrying double layer items 18, which in the flat condition are moved down or inserted between the plates 2 when these assume all open position as in FIG. 7.

Figure 3:
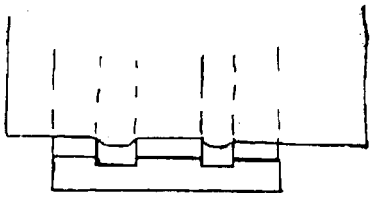
FIGS. 3 and 4 are sectional views of enlarged details of the device and item at two different positions.
Figure 4:
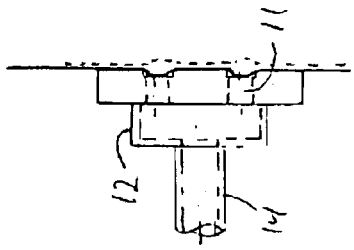
Figure 2:
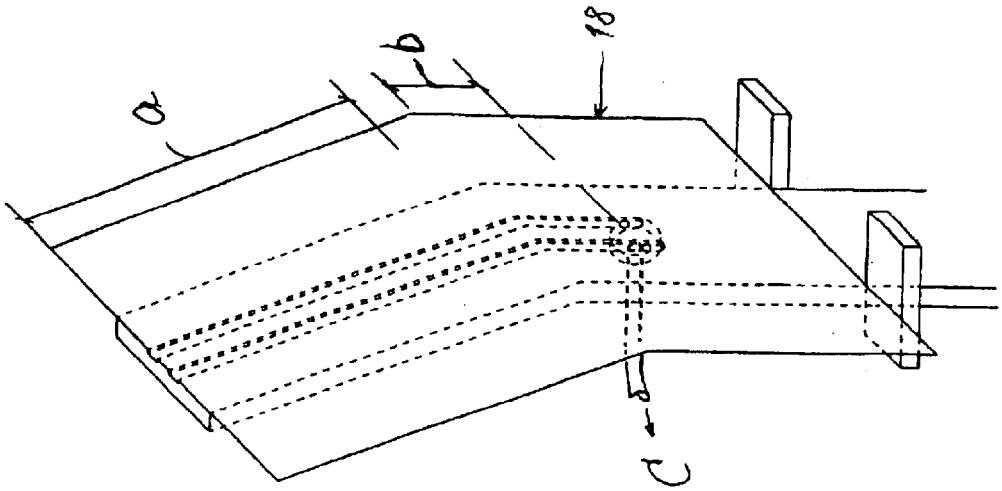
FIG. 2 is the same as FIG. 1 but with a gripped item.
Figure 5:
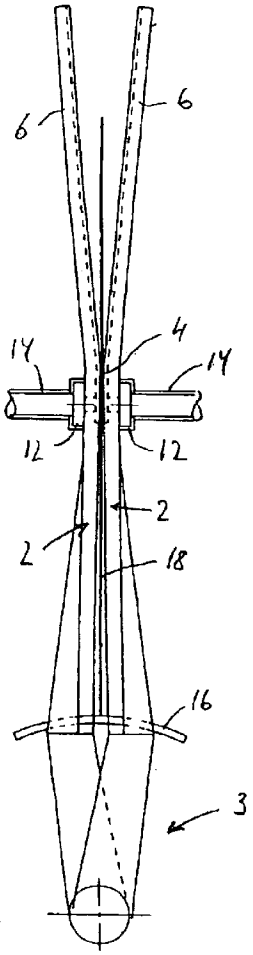

After this insertion of item, the plates 2 are closed, cf. FIG. 5, and vacuum is applied to the suction heads 12. Via the holes 11, a suction of respective sheet sides against the groove areas 8 at the holes 11 hereby occurs immediately so that the sides of tie items are here drawn inward into the grooves 8, of FIG. 4. The conditions are adapted in such a way that the sheet sides will be drawn inward into the grooves however, without blocking the holes 11 and without filling out the groove sections completely; in FIG. 4 is thus seen free corner areas of the groove cross-sections. These areas are important by enabling a propagation of the vacuum up the grooves 8 so that a corresponding suction of the sheet side occurs along the lower groove sections 10.

At the bends 4, there is an increasing dishes between the sheet sides and the bent plate parts 6, whereby suction cannot readily take place. The conditions for suction are, however, present at the bend area itself, where the sheet sides are sucked slightly out and away from each other by sucking into the grooves 8, cf. FIG. 4, now only with a small distance between the sheet sides. At these suctions, a condition for upward propagation or movement of the places where auction on may be performed just above the cross-section formed according to FIG. 4 is created, and in practice this means that the opposite sheet sides can be said to be peeled from each other and that they quite rapidly are brought to the position shown in FIG. 6, now abutting against respective bent plate parts 6.

Then the V-structure may immediately be opened to the position shown in FIG. 7 for receiving an insert, which then in the packed state may be drawn out from or fall out from the V-structure. This is preferably placed as a wing formation on a star wheel rotating in the vertical plane and carrying a suitable number of such wings, e.g. 12–28 pieces. A parallel operation of two or more succeeding wings may very well be arranged so that there may be worked with a very great capacity of the star wheel.

It may be sufficient that only one of the V branches is bent or curved It is difficult to provide concrete prescripts for geometrical conditions in the structure of the device according to the invention, inter alia because these, in an ideal embodiment, may depend on the kind, the size and the nature of the items to be handled. However, it will usually be so that the bent area 4 does not have to lie approximately at the centre of the item as shown as it may lie farther in as well as farther out, completely out to about 1 cm from the own outer position of the item, or the outermost edge in case of overlapping edges. The distance from the item bottom to the bend may e.g. be 5 to 20 cm.

Figure 6:
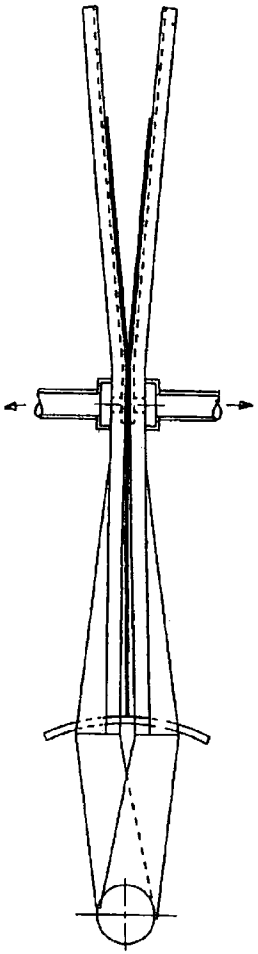

Tests performed indicate that it may benefit the efficiency to work with a differentiated or intermittent control of the vacuum application between the different phases of the suction/opening, cf. FIGS. 5–6, but it is not deemed necessary to discuss this more closely.

It has been mentioned and shown that use is made of "plates" 2, but it will be understood that these plate not necessarily are to extend over the complete range of items to be opened. A single wide plate may be provided with a multiple of mutually separated grooves or groups of grooves 8, but alternatively there may be used two or more mutually separated, narrow plates or rails that have a groove or a group of grooves.

In a standard version, the device will be suited for handling items of many different sizes implied that the height of the items may very well may be less than the length of the grooves 8, and possibly the above rails may be arranged in such a way that they are movable in the lateral direction.

As mentioned it may be applicable to open folded multilayer items joined at the back, such as newspapers, and thereby it will be important to use suction grooves 8 or corresponding suction means relatively close to the lateral edge representing the back joint of the item itself.

What is claimed is:

1. A method for opening or separating two closely joined sheets of a flexible material, including the steps:

inserting the joined sheets between two opposed leaves in which at least one leaf is partly bent outwards and away from the other opposed leaf;

turning the two opposed leaves about a common connection axis such that the leaves are moved towards each other;

establishing a vacuum through at least one perforation and groove provided in the surface of each leaf and facing the joined sheets, wherein an outer surface of each joined sheet is drawn by suction onto the adjacent leaf surface such that the suction of the outer surface of each joined sheet against the leaf surfaces propagates successively along the sheets to effect a progressive peeling off of the joined sheets from each other; and then tilting the two leaves away from each other with a previously joined sheet drawn onto each leaf.

2. A device for opening or separating two closely joined sheets of a pliable material, the device comprising:

at least one pair of mutually opposite leaves (2) that are pivotably connected along an edge at a lower part (3) of the leaves; and each leaf each being provided with an aperture adapted for connection to a vacuum source, wherein at least one leaf of the at least one pair of leaves is provided with a bend at a central area (4) such that the bend directs an upper part of the leaf outward and away from the other opposed leaf of the at least one pair of leaves to cause the upper part (6) of the at least one leaf to be oriented away from the opposed upper leaf part of the opposed leaf, wherein the connection to the vacuum source is arranged via the aperture at a position below the bend, and the opening is in fluid connection with one or more grooves (8), wherein each groove extends in the surface of the side walls of each leaf from a position below the bend, through a central area (4) of the bend and to a position on the upper, bent leaf part (6).

3. A device according to claim 2, wherein each of the leaves (2) is formed as a plate.

4. A device according to claim 2, further comprising a suction head (12) connecting each aperture to the vacuum source and being positioned at a back side of each leaf (2), wherein the suction head (12) is connected with the grooves (8) in the side walls (2).

5. A device according to claim 4, wherein each leaf is provided with two or more grooves (8), each of which has an associated aperture.

6. A device according to claim 2, wherein support pieces (16) for supporting the closely joined sheets are arranged adjacent each lateral edge of each leaf at a position below the bend.

7. A device according to claim 2, wherein a lower end section (3) extending between the bend (4) and the leaf bottom has a length between 50 and 200 mm.

8. A device according to claim 2, wherein the outward oriented upper part of the at least one leaf is of a curved or linear shape.

9. An arrangement comprising a plurality of the devices of claim 2, wherein the devices are radially mounted in star configuration on a rotary wheel such that each device is adapted to open in a direction which faces away from the centre of revolution of the wheel.

10. An arrangement according to claim 9, wherein the plurality of devices range from 12 to 28 devices and the devices are arranged equidistantly on the periphery of the wheel which rotates in a vertical plane.

* * * * *